US006385326B1

(12) United States Patent
Peng

(10) Patent No.: US 6,385,326 B1
(45) Date of Patent: May 7, 2002

(54) QUICK-DETACHABLE STRUCTURE FOR ON-WALL SPEAKER PANEL

(76) Inventor: Jack Peng, 9F, No. 21, Sec. 3, Min-Sheng E. Rd., Taipei (TW)

( * ) Notice: Subject to any disclaimer, the term of this patent is extended or adjusted under 35 U.S.C. 154(b) by 0 days.

(21) Appl. No.: 09/542,259

(22) Filed: Apr. 3, 2000

(51) Int. Cl.[7] ..... H04R 25/00

(52) U.S. Cl. ..... 381/386; 381/345; 381/189; 181/199

(58) Field of Search ..... 381/87, 332, 333, 381/152, 345, 386, 388, 391, 189, FOR 151, FOR 165; 181/155, 156, 199

(56) References Cited

U.S. PATENT DOCUMENTS

| | | | | | |
|---|---|---|---|---|---|
| 4,214,645 | A | * | 7/1980 | Plourde | 181/199 |
| 4,244,096 | A | * | 1/1981 | Kashichi | 181/199 |
| 5,115,884 | A | * | 5/1992 | Falco | 381/386 |
| 5,400,413 | A | * | 3/1995 | Kindel | 381/152 |
| 6,114,752 | A | * | 11/2000 | Chen | 381/386 |

* cited by examiner

*Primary Examiner*—Curtis Kuntz
*Assistant Examiner*—Suhan Ni
(74) *Attorney, Agent, or Firm*—Bacon & Thomas, PLLC

(57) ABSTRACT

Quick-detachable structure for on-wall speaker panel, including a frame body, a panel and several push buttons. The inner frame of the frame body is formed with an inward recessed step section. Certain positions of the step section are formed with insertion notches for inserting with the panel. The panel is formed with large and small sound holes. One end of the panel is disposed with latch plates. Certain positions of the panel are formed with several through holes for connecting with the push buttons with engaging plates. The latch plates of the panel are inserted in the insertion notches of the frame body and then the panel is pushed to be flush with the frame body. By means of sliding the push buttons, the engaging plates are engaged with the step section of the frame body so as to firmly engage the panel with the frame body. Reversely, when the push buttons are reversely pushed, the engaging plates are disengaged from the step section of the frame body so as to disengage the panel from the frame body. Therefore, the panel can be detached from the frame body of the speaker without using any tool and a speaker can be more conveniently and quickly installed.

6 Claims, 7 Drawing Sheets

QUICK-DETACHABLE STRUCTURE FOR ON-WALL SPEAKER PANEL

BACKGROUND OF THE INVENTION

The present invention relates to a quick-detachable structure for on-wall speaker panel, by which the panel can be detached from the frame body of the speaker without using any tool. Therefore, a base speaker or the like can be conveniently installed on or detached from a fixed position (such as a wall).

When enjoying music or a movie, a surrounding stereo equipment is necessary for playing sound or music with high quality. The power of the speaker of the stereo equipment plays an important role in deciding the quality of the sound. In general, the greater the power of the speaker of the stereo equipment is, the larger the volume and weight of the speaker are. In order to keep a beautiful appearance of the indoor environment, the speakers are generally installed in a wall or a ceiling. Accordingly, when decorated, a speaker outer frame is previously mounted at a predetermined position. After the decoration is completed, the speaker is installed in the outer frame. However, when installing the speaker, it is necessary to use a power tool to detach the outer frame to facilitate installation of the speaker. However, it is inconvenient to operate such tool. Moreover, the indoor decoration may be incautiously damaged by such tool.

SUMMARY OF THE INVENTION

It is therefore a primary object of the present invention to provide a quick-detachable structure for on-wall speaker panel. According to such structure, the panel can be detached from the frame body of the speaker fixedly mounted on a wall without using any tool. Therefore, a speaker can be more quickly and conveniently installed on a wall.

It is a further object of the present invention to provide the above quick-detachable structure for on-wall speaker panel, by which the speaker can be easily installed without damaging the indoor decoration.

It is still a further object of the present invention to provide the above quick-detachable structure for on-wall speaker panel, by which the appearance of the panel can be more versatile.

According to the above objects, the quick-detachable structure for on-wall speaker panel of the present invention includes a frame body, a panel and several push buttons. The inner frame of the frame body is formed with an inward recessed step section. Certain positions of the step section are formed with insertion notches for inserting with the panel. The panel is formed with large and small sound holes. One end of the panel is disposed with latch plates. Certain positions of the panel are formed with several through holes for connecting with the push buttons with engaging plates. The latch plates of the panel are inserted in the insertion notches of the frame body and then the panel is pushed to be flush with the frame body. By means of sliding the push buttons, the engaging plates are engaged with the step section of the frame body so as to firmly engage the panel with the frame body. Reversely, when the push buttons are reversely pushed, the engaging plates are disengaged from the step section of the frame body so as to disengage the panel from the frame body. Therefore, the panel can be detached from the frame body of the speaker without using any tool and a speaker can be more conveniently and quickly installed.

The present invention can be best understood through the following description and accompanying drawings wherein:

DETAILED DESCRIPTION OF THE PREFERRED EMBODIMENT

Figure 1:
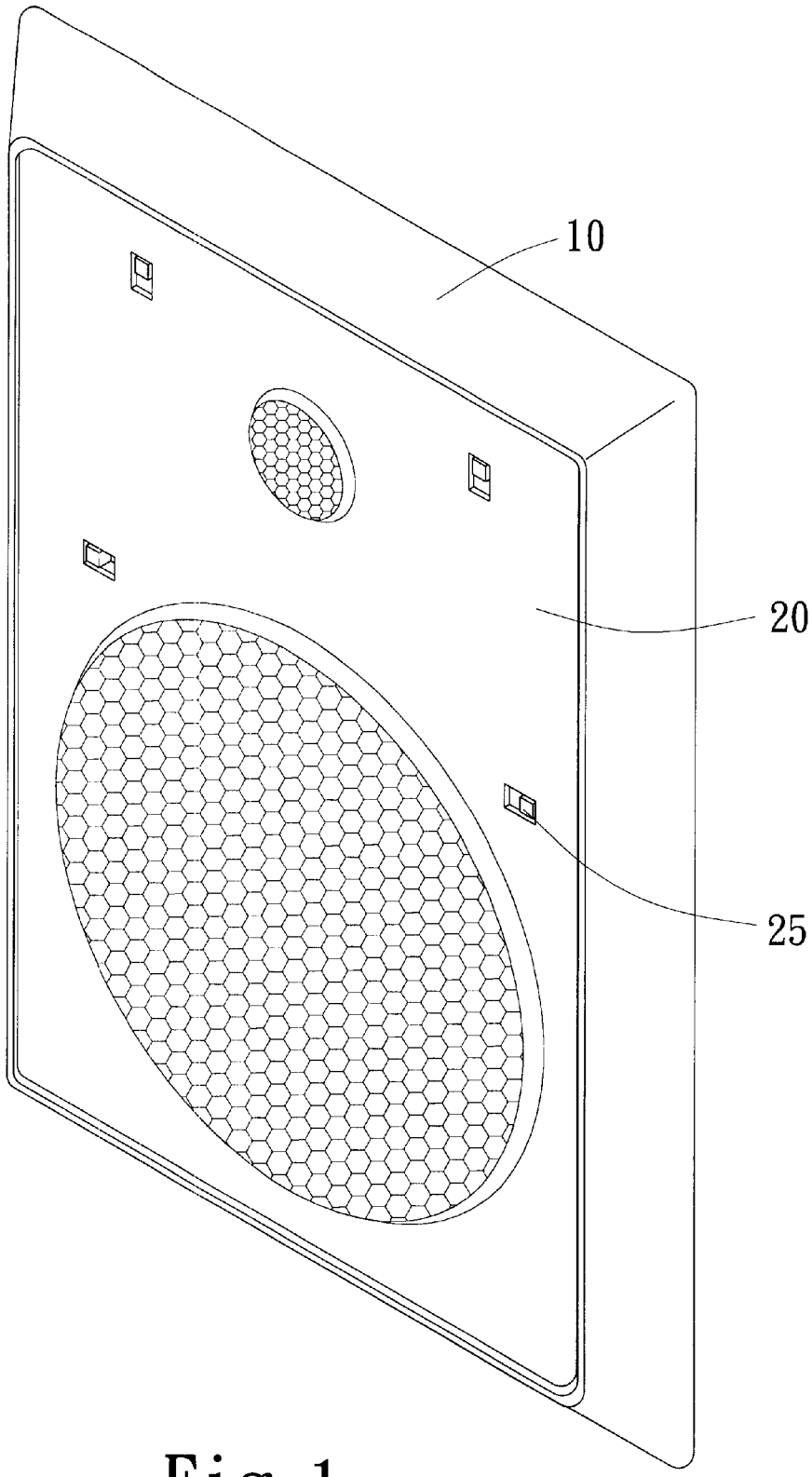
FIG. 1 is a perspective assembled view of the present invention.

Please refer to FIG. 1. The present invention includes a frame body 10, a panel 20 and several push buttons 25.

Figure 2:
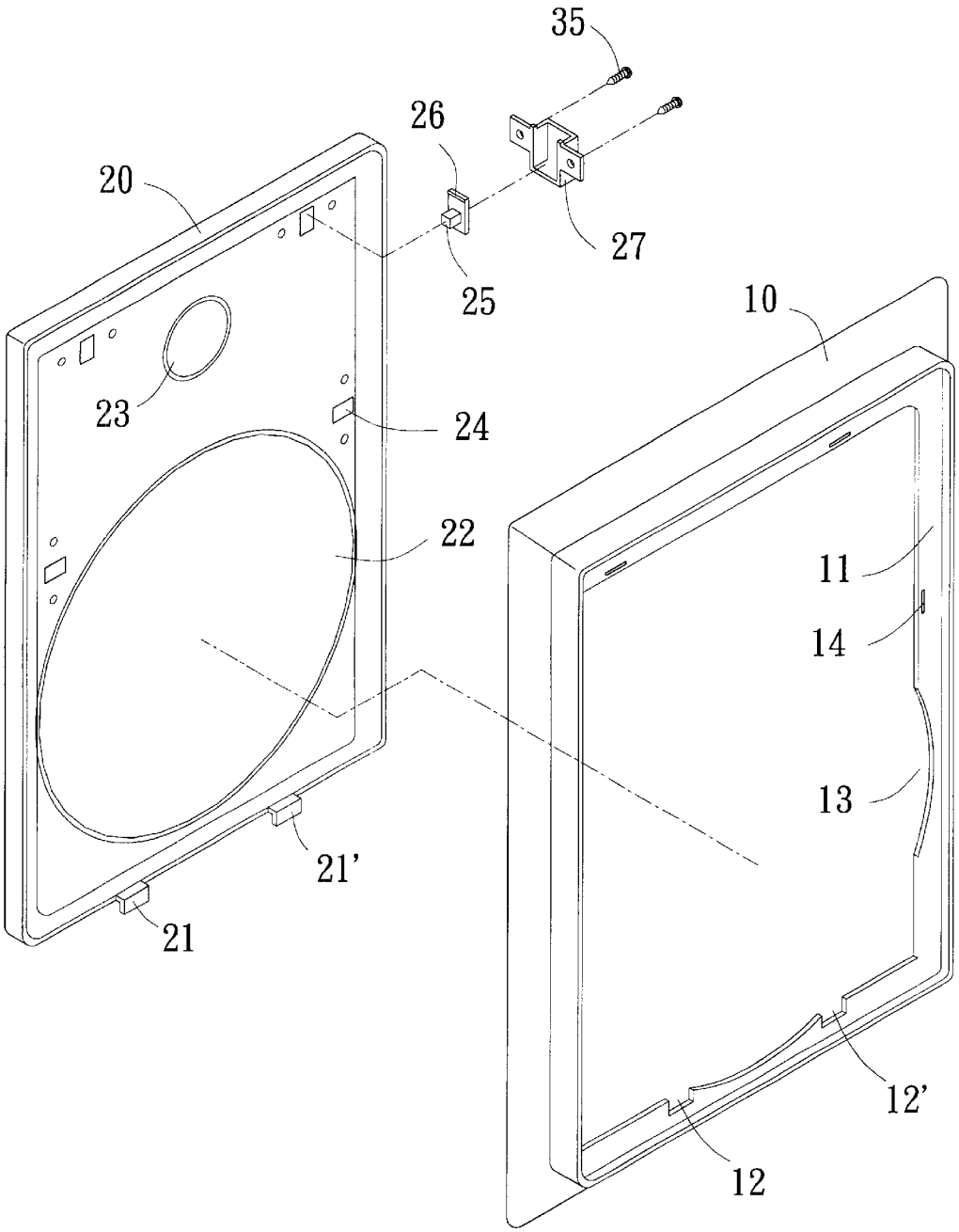
FIG. 2 is a perspective exploded view of the present invention.

Referring to FIG. 2, the inner frame of the frame body 10 is formed with an inward recessed step section 11. The bottom edge of the step section 11 is formed with two insertion notches 12, 12'. In addition, certain positions of the step section 11 are formed with multiple dents 14 and arched notches 13, 13'.

The panel 20 has a size corresponding to that of the inner frame of the frame body 10. The bottom edge of the panel 20 is disposed with two latch plates 21, 21'. The upper and lower sections of the panel 20 are respectively formed with a small and a large sound holes 23, 22. The periphery of the panel 20 is formed with several through holes 24 above the small and large sound holes 23, 22 for connecting with multiple push buttons 25.

The push button 25 has a rectangular block body and a small projecting section at the top of the block body. The bottom of the block body has an engaging plate 26 parallelly extending from the block body. A free end of the engaging plate 26 has a small projecting edge. The push button 25 is positioned in a push button outer casing 27. The outer casing 27 has two lateral wing plates each having a thread hole. An opening is defined between the two wing plates, whereby when the push button 25 is slided back and forth, the engaging plate 26 thereof can protrude from the opening or retract into the opening.

The small projecting section of the top face of the push button 25 is positioned in the through hole 24 of the panel 20. Then the outer casing 27 is overlaid on the bottom side of the push button 25. Then two screws 35 are screwed into the thread holes of the wing plates of the outer casing 27 so that the outer casing 27 is such tightly associated with the panel 20 that the push button 25 can be pushed therebetween.

Figure 3:
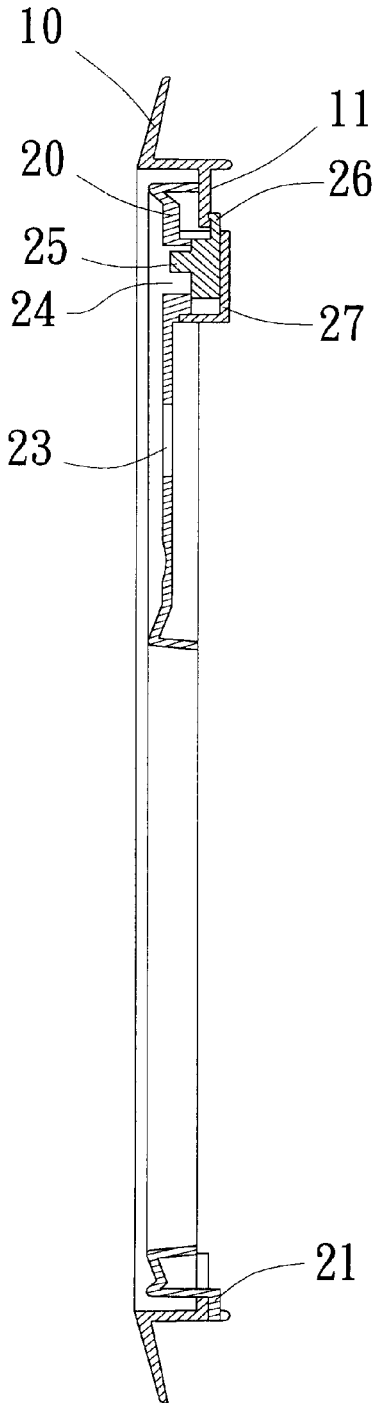
FIG. 3 is a sectional assembled view of the present invention.
Figure 5:
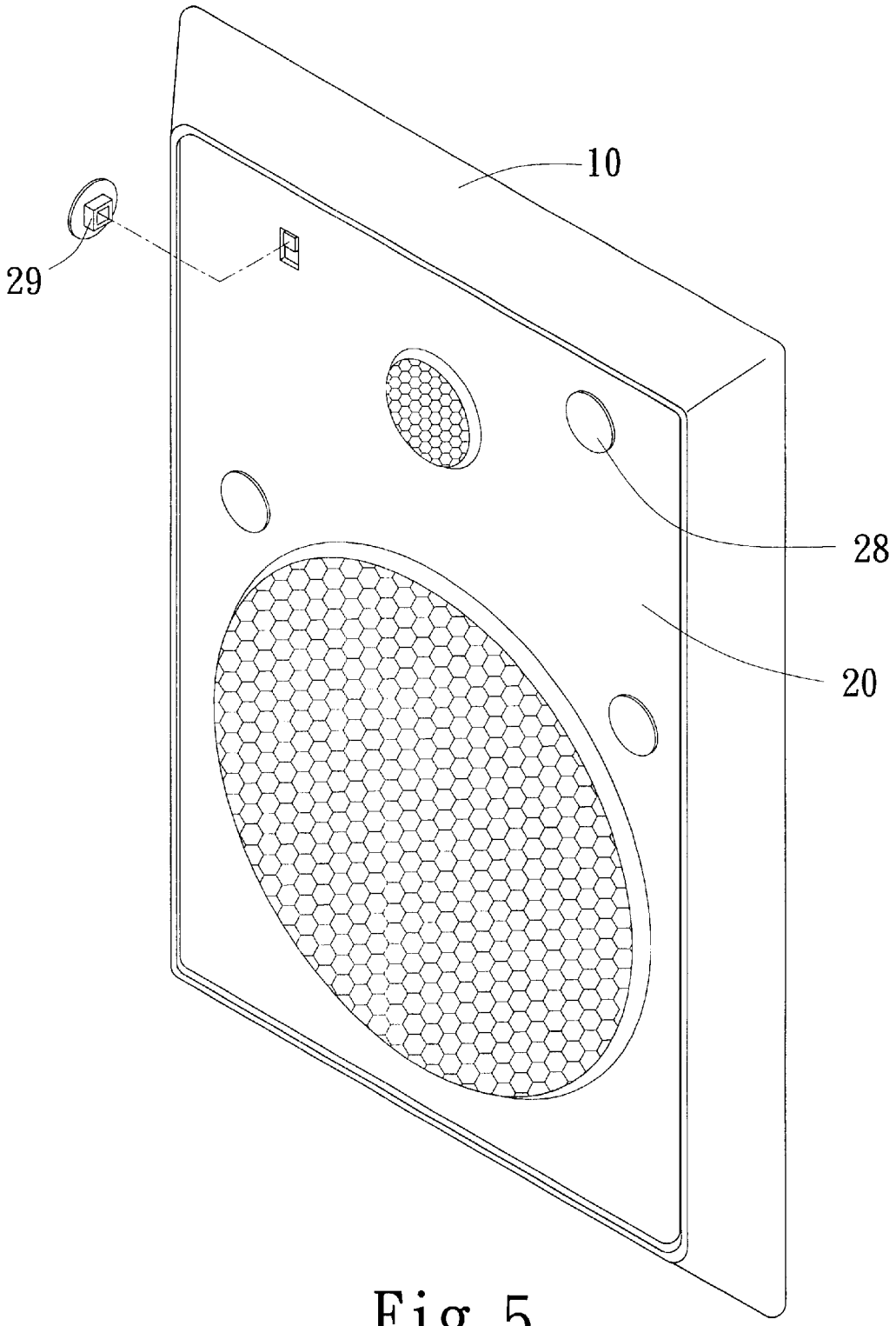
FIG. 5 shows that the push button of the present invention is associated with a decorative plate.

The latch plates 21, 21' of the bottom of the panel 20 are latched in the insertion notches 12, 12' of the frame body 10. Then the panel 20 is pushed inward to be flush with the frame body 10. At this time, two sides of the large sound hole 22 of the panel 20 snugly positioned in the arched notches 13, 13' of the step section 11 of the frame body 10. Then the push button 25 in the through hole 24 is pushed outward to make the engaging plate 26 of the bottom of the push button 25 engaged in the dent 14 of the step section 11 of the frame body 10 (as shown in FIG. 3). At this time, the frame body 10 is assembled with the panel 20. Moreover, in order to cover the exposed through hole 24 of the panel 20 and the push button 25 so as to beautify the appearance of the panel 20, as shown in FIG. 5, a decorative plate 28 with a fitting post 29 on bottom is fitted with the push button 25 in the through hole 24 so as to hide the through hole and the push button and make the appearance of the panel 20 versatile.

Figure 4:
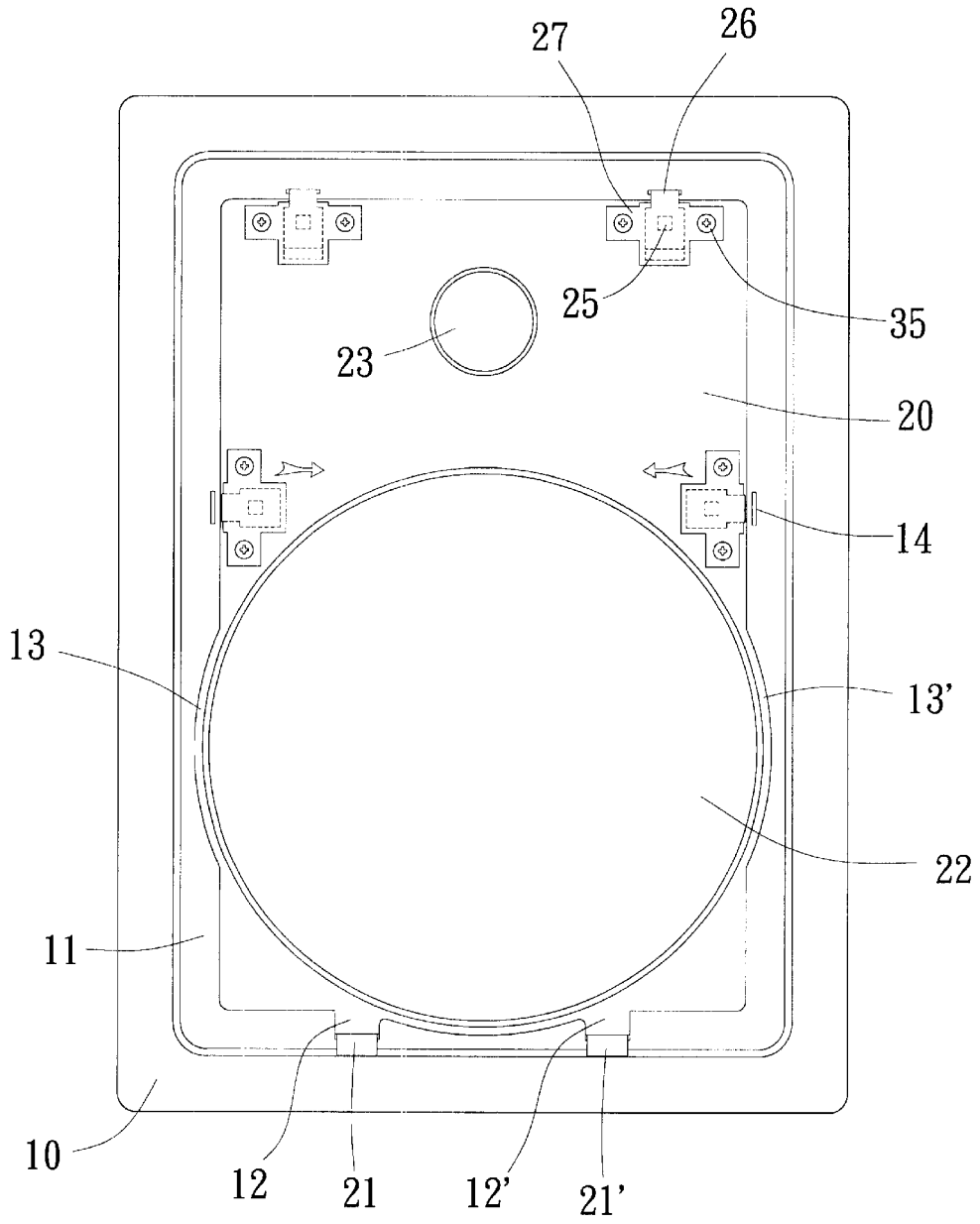
FIG. 4 is a back view of the present invention, showing the detachment of the panel from the frame body.

Referring to FIG. 4, when detaching the panel 20, it is only necessary to slightly press the push button 25 so as to slightly separate the small projecting edge of the engaging plate 26 from the dent 14. Thereafter, the push button 25 is conveniently moved inward to disengage the engaging plate 26 of the push button 25 from the step section 11 of the frame body 10. Then the panel 20 is pulled outward to unlatch the latch plates 21, 21' of the panel 20 from the insertion notches 12, 12' of the frame body. At this time, the panel is separated from the frame body.

Figure 6:
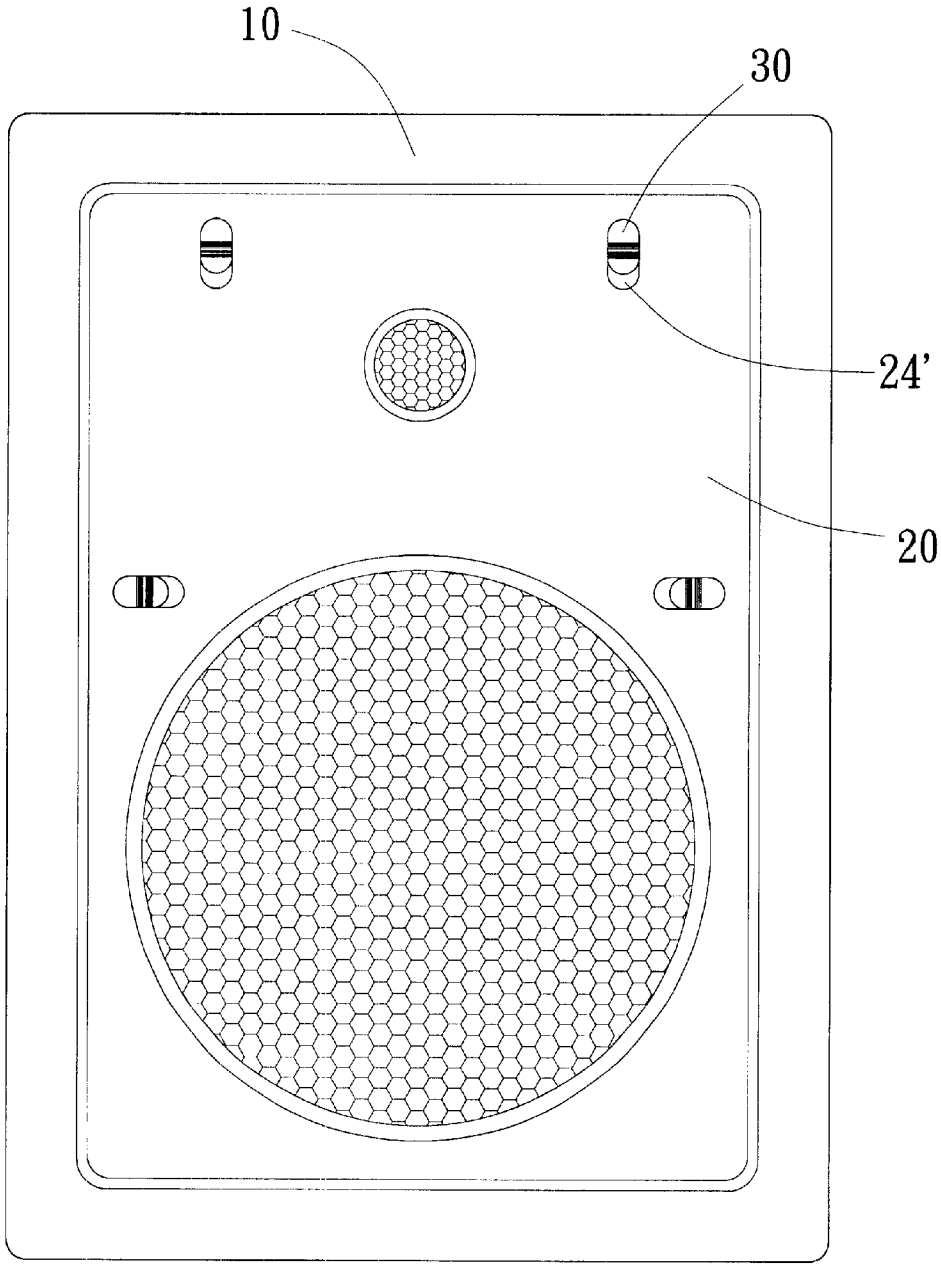
FIG. 6 is a top view of a second embodiment of the present invention.
Figure 7:
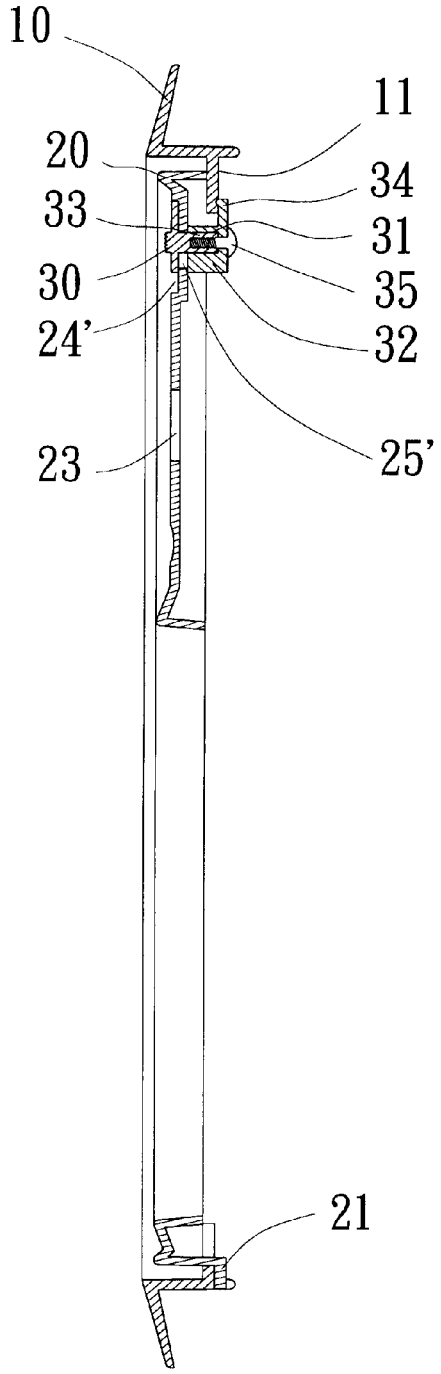
FIG. 7 is a sectional assembled view of the second embodiment of the present invention.

FIGS. 6 and 7 show a second embodiment of the present invention, in which the through holes 24 of the panel 20 are replaced by several recesses 24' in each of which a through hole 25' is formed for connecting with a push button 30. The push button 30 has a projecting section on the surface for easy push. The bottom of the push button 30 is disposed with a thread post 31. The thread post 31 is passed through the through hole 25' to fit into a thread hole of a post 33 of a push button outer casing 32 on the back side. A screw 35 is used to lock the push button with the outer casing 32. The end of the outer casing 32 has a parallelly extending engaging plate 34 which is synchronously operated with the push button 30. When the push button 30 is moved outward, the engaging plate 34 is engaged in the dent 14 of the step section 11. When the push button 30 is moved inward, the engaging plate 34 is disengaged from the dent 14.

The above embodiments are only used to illustrate the present invention, not intended to limit the scope thereof. Many modifications of the above embodiments can be made without departing from the spirit of the present invention.

What is claimed is:

1. Quick-detachable structure for on-wall speaker panel, comprising:

a frame body, an inner frame of the frame body being formed with a step section, certain positions of the step section being formed with dents and insertion notches for engaging with the panel;

a panel formed with several sound holes, one end of the panel being disposed with latch plates, certain positions of the panel being formed with several through holes for respectively connecting with push buttons with engaging plates; and several push buttons, a top face of each of the push buttons being disposed with a projecting section, a bottom face thereof being disposed with an engaging plate, the push button being movably locked in the through hole of the panel by means of a push button outer casing, said quick-detachable structure being characterized in that the latch plates of the panel are inserted in the insertion notches of the frame body and then the panel is pushed to be flush with the frame body, whereby by means of sliding the push buttons, the frame body is firmly engaged with the panel or disengaged from the panel.

2. Quick-detachable structure for on-wall speaker panel as claimed in claim 1, wherein the push button outer casing has two lateral wing plates each having a thread hole, the two wing plates defining therebetween an opening.

3. Quick-detachable structure for on-wall speaker panel as claimed in claim 1, wherein the push button is fitted with a fitting post of a bottom of a decorative plate.

4. Quick-detachable structure for on-wall speaker panel as claimed in claim 2, wherein the push button is directly screwed with the push button outer casing.

5. Quick-detachable structure for on-wall speaker panel as claimed in claim 4, wherein the bottom edge of the push button outer casing is disposed with an engaging plate.

6. Quick-detachable structure for on-wall speaker panel as claimed in claim 1, wherein the end of the engaging plate of the push button is formed with a small projecting edge.

* * * * *

UNITED STATES PATENT AND TRADEMARK OFFICE
Certificate

Patent No. 6,385,326 B1 Patented: May 7, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jack Peng, Taipei, Taiwan; Albert Burdett, Miami, FL; and Lowell J. Smith, South Ranchos, Palos Verdes, CA.

Signed and Sealed this First Day of June 2004.

CURTIS KUNTZ
*Supervisory Patent Examiner*
Art Unit 2600